US010651577B2

(12) United States Patent
Ho et al.

(10) Patent No.: US 10,651,577 B2
(45) Date of Patent: May 12, 2020

(54) ELECTRICAL CONNECTOR

(71) Applicant: LOTES CO., LTD, Keelung (TW)

(72) Inventors: Chien Chih Ho, Keelung (TW); Zuo Feng Jin, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 16/386,401

(22) Filed: Apr. 17, 2019

(65) Prior Publication Data

US 2019/0326690 A1 Oct. 24, 2019

(30) Foreign Application Priority Data

Apr. 24, 2018 (CN) ..... 2018 1 0371561

(51) Int. Cl.

| | |
|---|---|
| ***H01R 12/70*** | (2011.01) |
| ***H01R 4/02*** | (2006.01) |
| ***H01R 12/71*** | (2011.01) |
| ***H01R 13/24*** | (2006.01) |
| ***H01R 13/41*** | (2006.01) |
| ***H01R 33/74*** | (2006.01) |

(52) U.S. Cl.

CPC ..... *H01R 12/7076* (2013.01); *H01R 4/029* (2013.01); *H01R 12/716* (2013.01); *H01R 13/2442* (2013.01); *H01R 13/41* (2013.01); *H01R 33/74* (2013.01)

(58) Field of Classification Search

CPC .. H01R 23/722; H01R 9/096; H01R 12/7076; H01R 12/716; H01R 4/029; H01R 13/2442; H01R 13/41; H01R 33/74

USPC ..... 439/66, 515

See application file for complete search history.

(56) References Cited

U.S. PATENT DOCUMENTS 4,362,353 A * 12/1982 Cobaugh ..... H05K 7/10 29/882
6,149,467 A * 11/2000 Choy ..... H01R 12/721 439/515
6,280,254 B1 * 8/2001 Wu ..... H01R 13/2442 439/515
6,293,814 B1 * 9/2001 Tan ..... G01R 1/0433 439/188

(Continued)

FOREIGN PATENT DOCUMENTS

CN 201204289 Y 3/2009
CN 201266710 Y 7/2009

(Continued)

*Primary Examiner* — Gary F Paumen

(74) *Attorney, Agent, or Firm* — Locke Lord LLP; Tim Tingkang Xia, Esq.

(57) ABSTRACT

An electrical connector is used to electrically connect an electronic component to a circuit board, and includes an insulating body, at least one first terminal and at least one second terminal. The first terminal has a base accommodated in the insulating body, and a first elastic arm extending upward from the base and at least partially located above the insulating body. The first elastic arm is used to abut the electronic component. The second terminal has a fixed end and a second elastic arm connected to each other. The fixed end is at least partially located above the insulating body and fixed to the first elastic arm, and at least a portion of the second elastic arm is located in the insulating body and is slidably in contact with the first terminal.

24 Claims, 8 Drawing Sheets

(56) References Cited

U.S. PATENT DOCUMENTS

| | | | | |
|---|---|---|---|---|
| 7,556,503 | B2 * | 7/2009 | Vinther | H01R 12/714 439/515 |
| 8,353,730 | B1 * | 1/2013 | Wang | H01R 13/2421 439/515 |
| 8,641,449 | B2 * | 2/2014 | Cai | H01R 13/6581 439/515 |
| 2005/0287867 | A1 * | 12/2005 | Tran | H01R 13/2407 439/515 |

FOREIGN PATENT DOCUMENTS

| | | | |
|---|---|---|---|
| CN | 101212095 | B | 1/2012 |
| CN | 202585853 | U | 12/2012 |
| CN | 203631808 | U | 6/2014 |

* cited by examiner

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201810371561.0 filed in China on Apr. 24, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector for connecting a chip module to a circuit board by virtue of a terminal with dual conductive channels.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector has an insulating body, and multiple terminals are accommodated in the insulating body. Each terminal has a base accommodated in the insulating body. A main elastic arm extends upward to be above the insulating body from an upper end of the base. An upper end of the main elastic arm has a contact portion used to abut a chip module. An auxiliary elastic arm extends upward out of an upper surface of the insulating body from a lower end of the base. A free tail end of the auxiliary elastic arm has a contact, which upward abuts the main elastic arm. When the chip module downward abuts the main elastic arm, the main elastic arm moves downward, and the auxiliary elastic arm slides along the main elastic arm and supports the main elastic arm upward. A conduction portion bends and extends from the base laterally. The conduction portion is electrically connected to a circuit board, such that the electrical connector can electrically connect the chip module and the circuit board.

However, the contact is an elastic tail end of the auxiliary elastic arm, which may freely slide along the main elastic arm, and both the main elastic arm and the auxiliary elastic arm are located on an upper surface of the insulating body. In case of vibration during a transportation or mounting process, an external force may easily apply to the main elastic arm and the auxiliary elastic arm, such that the auxiliary elastic arm is prone to deformation, and the contact deflects from the main elastic arm left and right to form a gap between the contact and the main elastic arm, thereby resulting in separation of the auxiliary elastic arm from the main elastic arm. Thus, when the main elastic arm is pressed downward, the auxiliary elastic arm does not support the main elastic arm upward, resulting in only the main elastic arm bearing the downward pressure of the chip module, and excessive elastic deformation of the main elastic arm, such that the electrical transmission between the electrical connector and the chip module is unstable. Meanwhile, electrical signals of a conductive terminal can be transmitted to the conduction portion only through the main elastic arm, and the auxiliary elastic arm forms an electrical stub, which is an invalid path for transmitting the electrical signal, thereby increasing impedance of the terminal, and deteriorating the electrical performance of the electrical connector.

Therefore, a heretofore unaddressed need to design a novel electrical connector exists in the art to address the aforementioned deficiencies and inadequacies.

SUMMARY

The present invention is directed to an electrical connector, where a first terminal and a second terminal are fixed by soldering to form dual-channel terminals that are stably in contact, so as to achieve good conductivity.

To achieve the foregoing objective, the present invention adopts the following technical solutions. An electrical connector is configured to electrically connect an electronic component to a circuit board, and includes: an insulating body; at least one first terminal, having a base accommodated in the insulating body, and a first elastic arm extending upward from the base and at least partially located above the insulating body, wherein the first elastic arm is configured to abut the electronic component; and at least one second terminal, having a fixed end and a second elastic arm connected to each other, wherein the fixed end is at least partially located above the insulating body and fixed to the first elastic arm, and at least a portion of the second elastic arm is located in the insulating body and is slidably in contact with the first terminal.

In certain embodiments, the first elastic arm has a first portion bending and extending upward from the base, and a second portion bending and extending upward from the first portion, the first portion and the second portion form an accommodating space, and the second elastic arm is at least partially accommodated in the accommodating space.

In certain embodiments, a left-right direction is defined to be perpendicular to a plate surface of the base, the first portion extends leftward from the base, the second portion bends reversely from the first portion and extends rightward from left, a contact portion extends upward from the second portion and configured to be in electrical contact with the electronic component, and the first portion and the contact portion are respectively located at a left side and a right side of the base.

In certain embodiments, the second elastic arm has a third portion and a fourth portion accommodated in the accommodating space, the third portion is connected upward to the fixed end, the fourth portion bends and extends downward from the third portion, and the third portion and the fourth portion are located at a left side of a location connecting the contact portion and the second portion.

In certain embodiments, the third portion and the second portion are provided face-to-face in the left-right direction, and the fourth portion and the first portion are provided face-to-face in the left-right direction.

In certain embodiments, a fifth portion extends and bends downward from the fourth portion, an abutting portion extends from the fifth portion toward the base and configured to abut the base, a connecting portion connects the abutting portion and the fifth portion, and the connecting portion extends obliquely downward from top toward the base.

In certain embodiments, a projection of the abutting portion and a projection of the fixed end in a vertical direction are overlapped.

In certain embodiments, the fixed end and the first elastic arm are face-to-face soldered to each other.

In certain embodiments, a conduction portion is connected to a lower end of the base, the conduction portion is connected to a solder configured to be electrically connected to the circuit board, a lower end of the second elastic arm has an abutting portion located above the conduction portion and configured to be slidably in contact with the base, and the abutting portion is located in the insulating body.

In certain embodiments, when the electronic component abuts the first elastic arm, the first elastic arm moves downward, and the abutting portion moves along the base toward the conduction portion.

In certain embodiments, the base is provided vertically and fixed to the insulating body, and the abutting portion slides vertically along the base.

In certain embodiments, the electrical connector further has a plurality of first terminals and a plurality of second terminals, wherein the insulating body has a plurality of accommodating cavities running vertically and configured to correspondingly accommodate the first terminals and the second terminals, and each of the accommodating cavities correspondingly accommodates one of the first terminals and one of the second terminals.

In certain embodiments, each of the accommodating cavities has a first cavity and a second cavity communicated with the first cavity, a width of the first cavity is greater than a width of the second cavity, the base is fixed to the first cavity, the first elastic arm is at least partially across and accommodated in the first cavity and the second cavity, and the first elastic arm extends out of the insulating body from the first cavity.

In certain embodiments, a lower end of the second elastic arm has an abutting portion, and the abutting portion is accommodated in the first cavity and slidably in contact with the base.

In certain embodiments, the second elastic arm is at least partially across and accommodated in the first cavity and the second cavity.

In certain embodiments, a first direction and a second direction perpendicular to each other are defined, the accommodating cavities form a first row and a second row of the accommodating cavities in the first direction provided in parallel and staggeredly, each of the accommodating cavities has a first cavity and a second cavity communicated with each other and running through an upper surface and a lower surface of the insulating body, a width of the first cavity is greater than a width of the second cavity, and a projection of the first cavity of each of the accommodating cavities in the first row and a projection of the second cavity of each of the accommodating cavities in the second row in the second direction are overlapped.

In certain embodiments, the first elastic arm and the second elastic arm are at least partially accommodated in the second cavity, the first elastic arm is exposed on the upper surface of the insulating body and the lower surface of the insulating body through the second cavity.

In certain embodiments, when viewing the second cavity downward from top, the first elastic arm shields the second elastic arm, and when viewing the second cavity upward from bottom, the first elastic arm at least partially shields the second elastic arm.

In certain embodiments, the first cavity of one of the accommodating cavities in the second row is provided between the second cavities of two adjacent ones of the accommodating cavities in the first row.

In certain embodiments, a conduction portion extends downward from each of the first terminals, the conduction portion is exposed on the lower surface of the insulating body, and a projection of the conduction portion and a projection of the corresponding first cavity in a vertical direction are overlapped.

Another technical solution of the present invention may also be adopted as follows. An electrical connector is configured to electrically connect an electronic component to a circuit board, and includes: an insulating body; at least one first terminal, having a base fixed to the insulating body, a first elastic arm extending upward from the base out of an upper surface of the insulating body and configured to be in electrical contact with the electronic component, and a conduction portion extending from a lower end of the base and configured to be electrically connected to the circuit board; and at least one second terminal, having a fixed end and a second elastic arm extending downward from the fixed end, wherein the fixed end is soldered to the first elastic arm, the second elastic arm is slidably in contact with the base, the base has a first position and a second position, the first position is higher than the second position, the second elastic arm slidably move back and forth along the first position and the second position, and when the electronic component downward abuts the first elastic arm, the second elastic arm slides from the first position to the second position.

In certain embodiments, an upper end of the first elastic arm has a contact portion configured to be electrically connected to the electronic component, the fixed end is fixed below the contact portion, and the fixed end and the contact portion are staggeredly provided in a vertical direction.

In certain embodiments, the second position is located closer to the conduction portion than the first position.

In certain embodiments, the insulating body has at least one accommodating cavity configured to accommodate the first terminal and the second terminal, and the first position and the second position are located in the accommodating cavity.

Compared with the related art, the fixed end is located above the insulating body and soldered to the first elastic arm, such that a stable effect therebetween is good. At least a portion of the second elastic arm is located in the insulating body and is slidably in contact with the first terminal. When the electrical connector is in a mounting or transportation process, and an external force is applied to the terminal, the first elastic arm and the fixed end cannot be easily separated by the external force, thereby maintaining a good electrical connection therebetween, and facilitating transmission of the electrical signals. The insulating body may protect the portion of the second elastic arm located therein, thereby preventing the portion of the second elastic arm from having an excessive elastic deformation caused by the external force or having a left-right deflection relative to the base, which may result in a gap being formed between the second elastic arm and the base and deteriorating transmission of the electrical signal. The second elastic arm further has an abutting portion which may slide vertically between the first position and the second position along the base, and the second position is located closer to the circuit board than the first position. Compared with the case where the abutting portion abuts the first position, the abutting portion abutting the second position enables the electrical signal transmitted through the second terminal to be transmitted from the second terminal to the conduction portion through a shorter conductive path, thereby accelerating transmission of the electrical signal. Further, in the process that the abutting portion slides from the first position to the second position, the abutting portion may scrape off the substances affecting the conductive transmission such as impurities, dust or an oxidized conductive layer on a right plate surface of the base, thereby further reducing contact impedance between the abutting portion and the base, and facilitating transmission of the electrical signals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
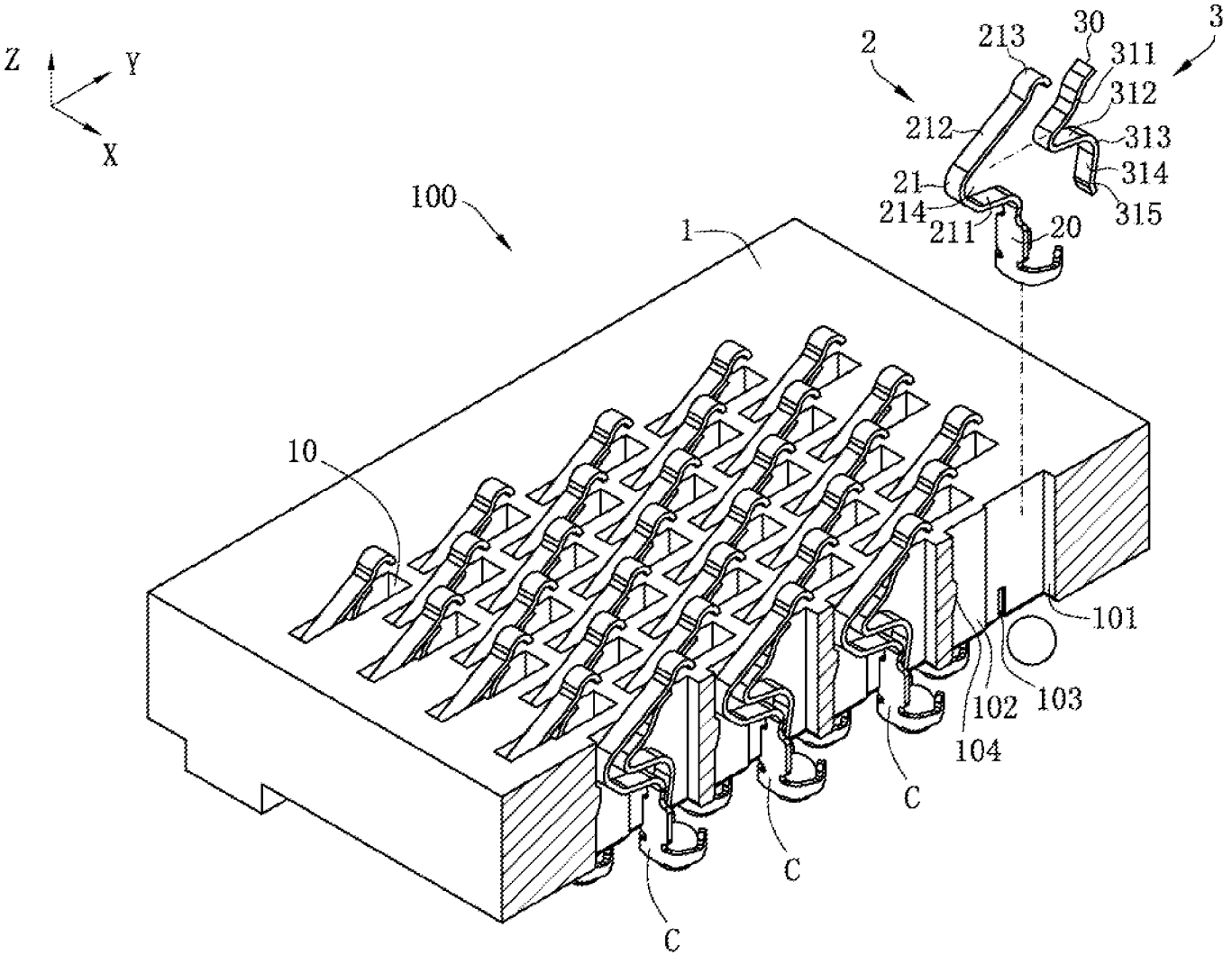
FIG. 1 is a perspective sectional view of an electrical connector according to an embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector.

Figure 2:
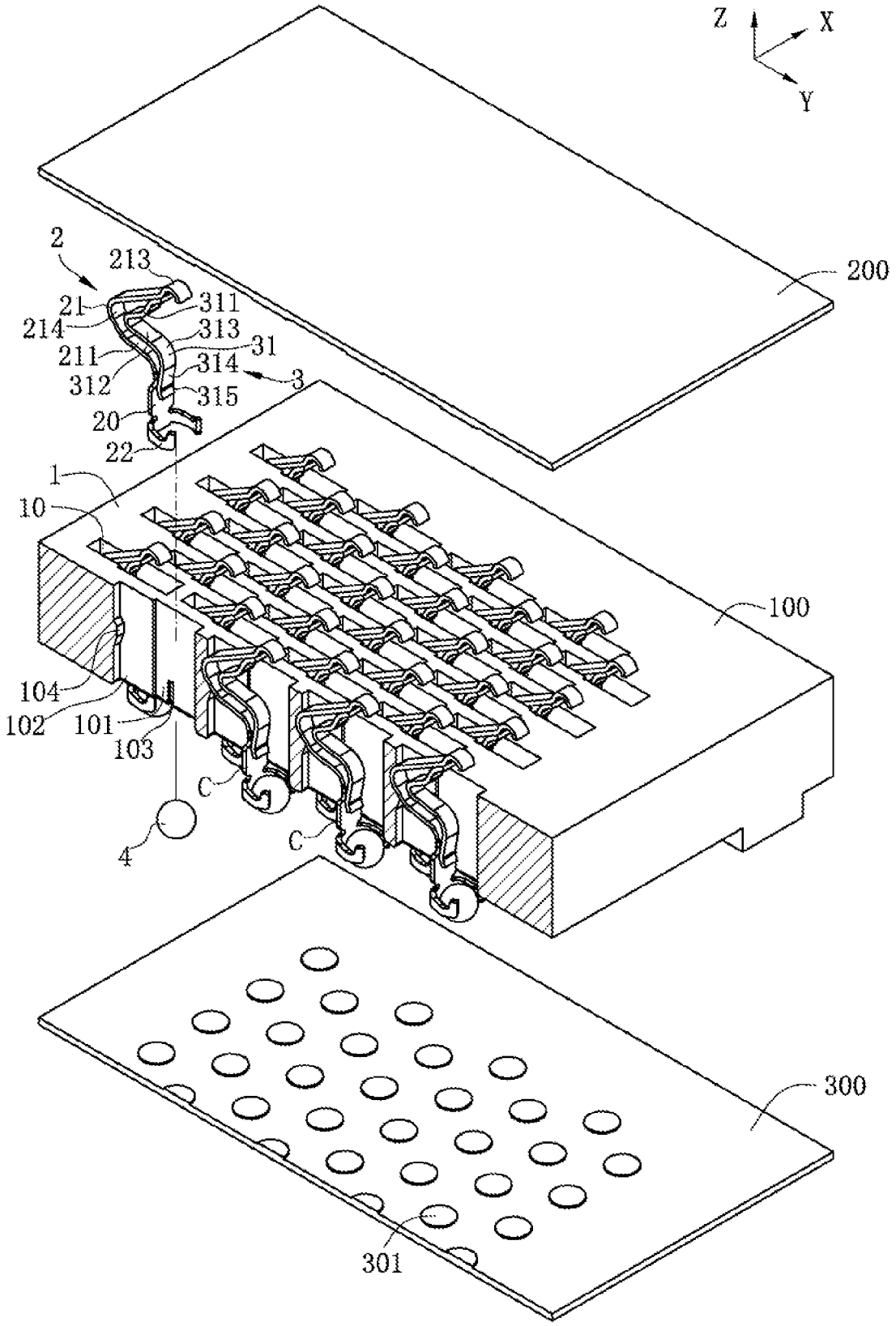
FIG. 2 is a perspective exploded view of the electrical connector in FIG. 1, a chip module, and a circuit board.
Figure 3:
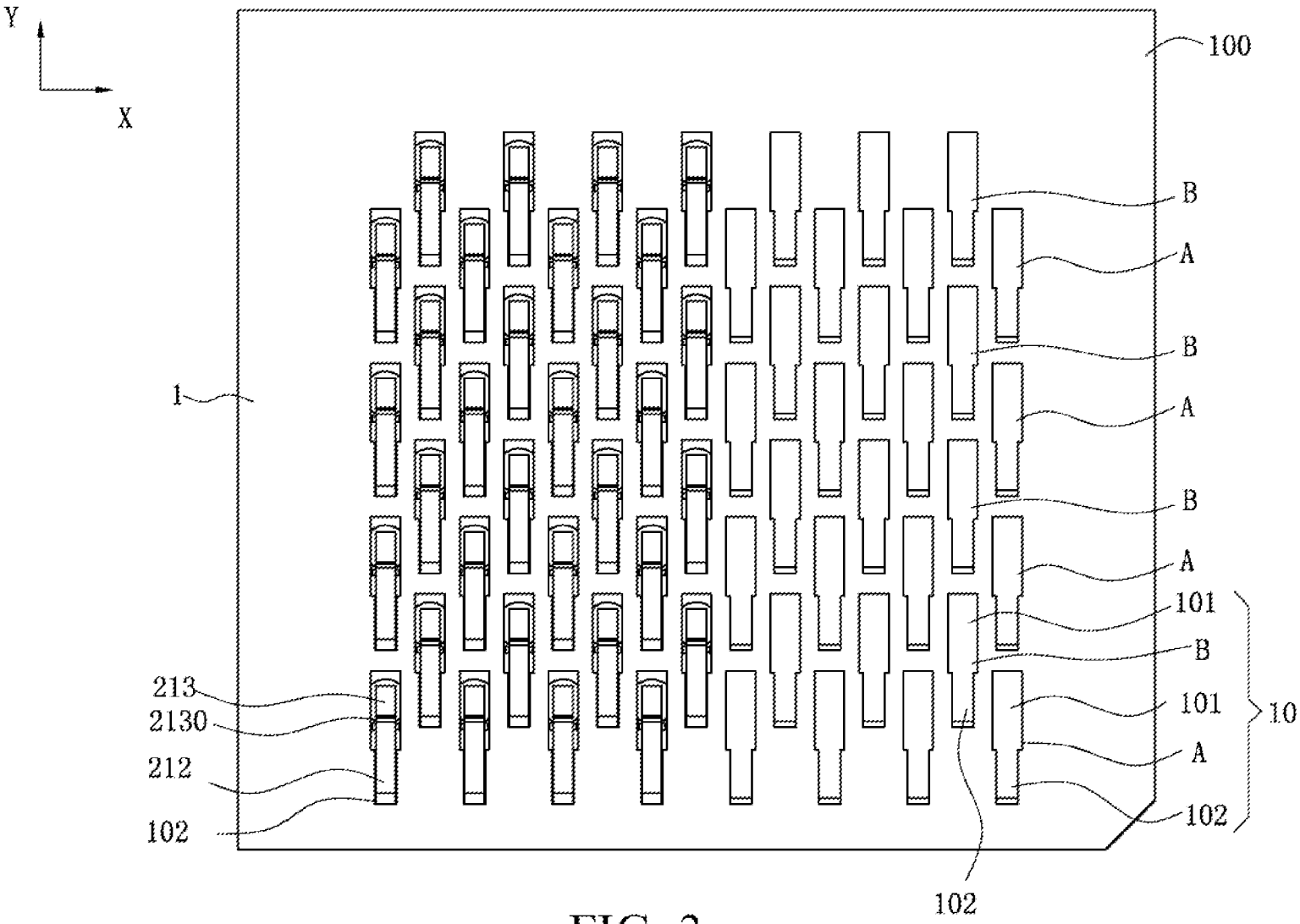
FIG. 3 is a plain view of the electrical connector in FIG. 1 viewing downward from top.

FIG. 1, FIG. 2 and FIG. 3 show an electrical connector 100 according to an embodiment of the present invention. The electrical connector 100 is mounted on a circuit board 300 in a vertical direction Z, and the circuit board 300 has multiple gaskets 301. The electrical connector 100 is mated with a chip module 200 in the vertical direction Z, and the chip module 200 is provided with multiple conductive sheets 201. The electrical connector 100 has an insulating body 1, and multiple terminals C are accommodated in the insulating body 1. An upper end of each terminal C is in electrical contact with a corresponding conductive sheet 201. A lower end of each terminal C matches with a solder 4, and the solder 4 is attached to a corresponding gasket 301, such that the terminal C is electrically connected to the gasket 301, thereby implementing the electrical connection of the electrical connector 100 between the circuit board 300 and the chip module 200.

Figure 6:
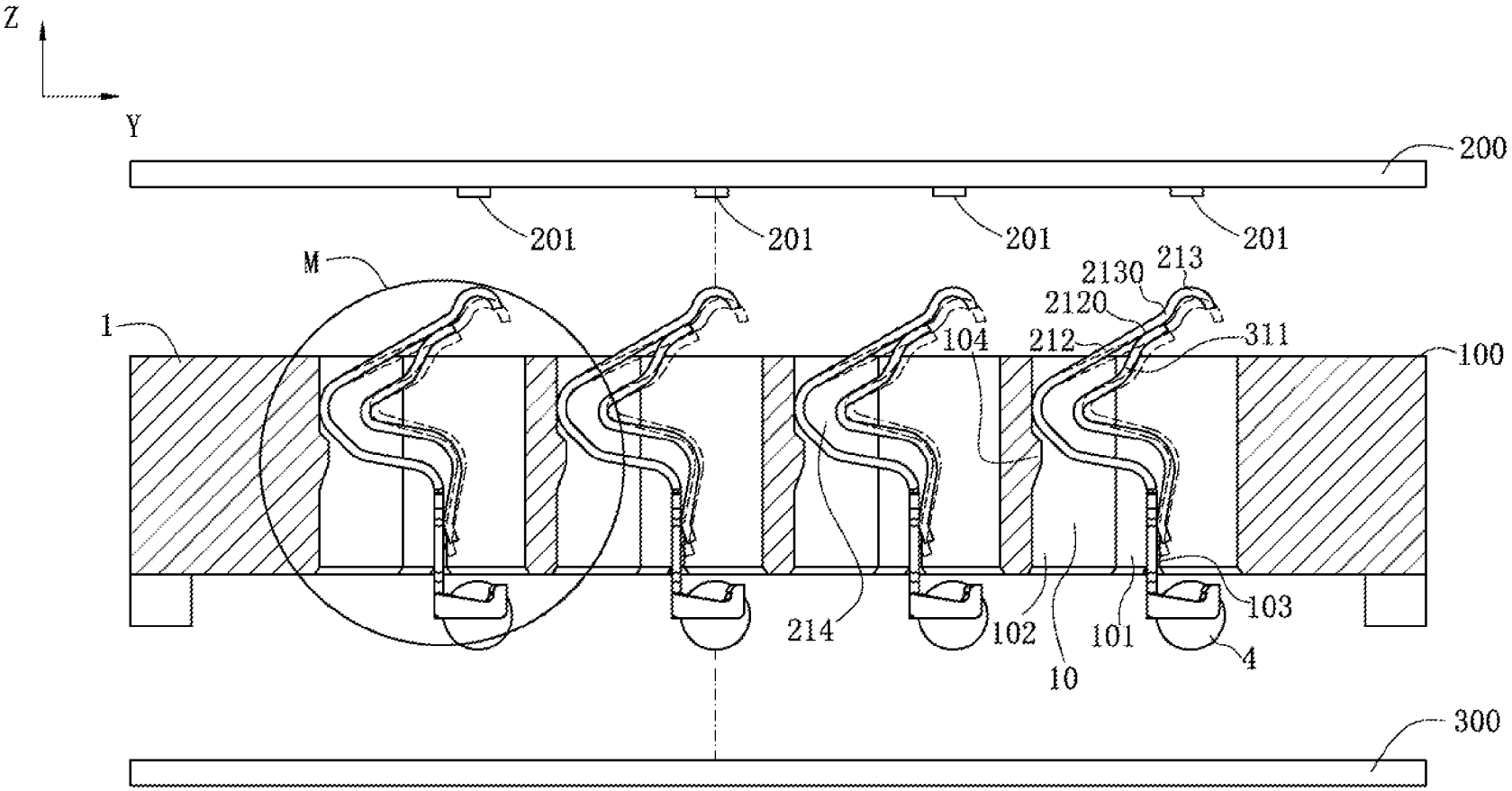
FIG. 6 is a plain sectional view of the electrical connector in FIG. 1 before being mated with the chip module.
Figure 7:
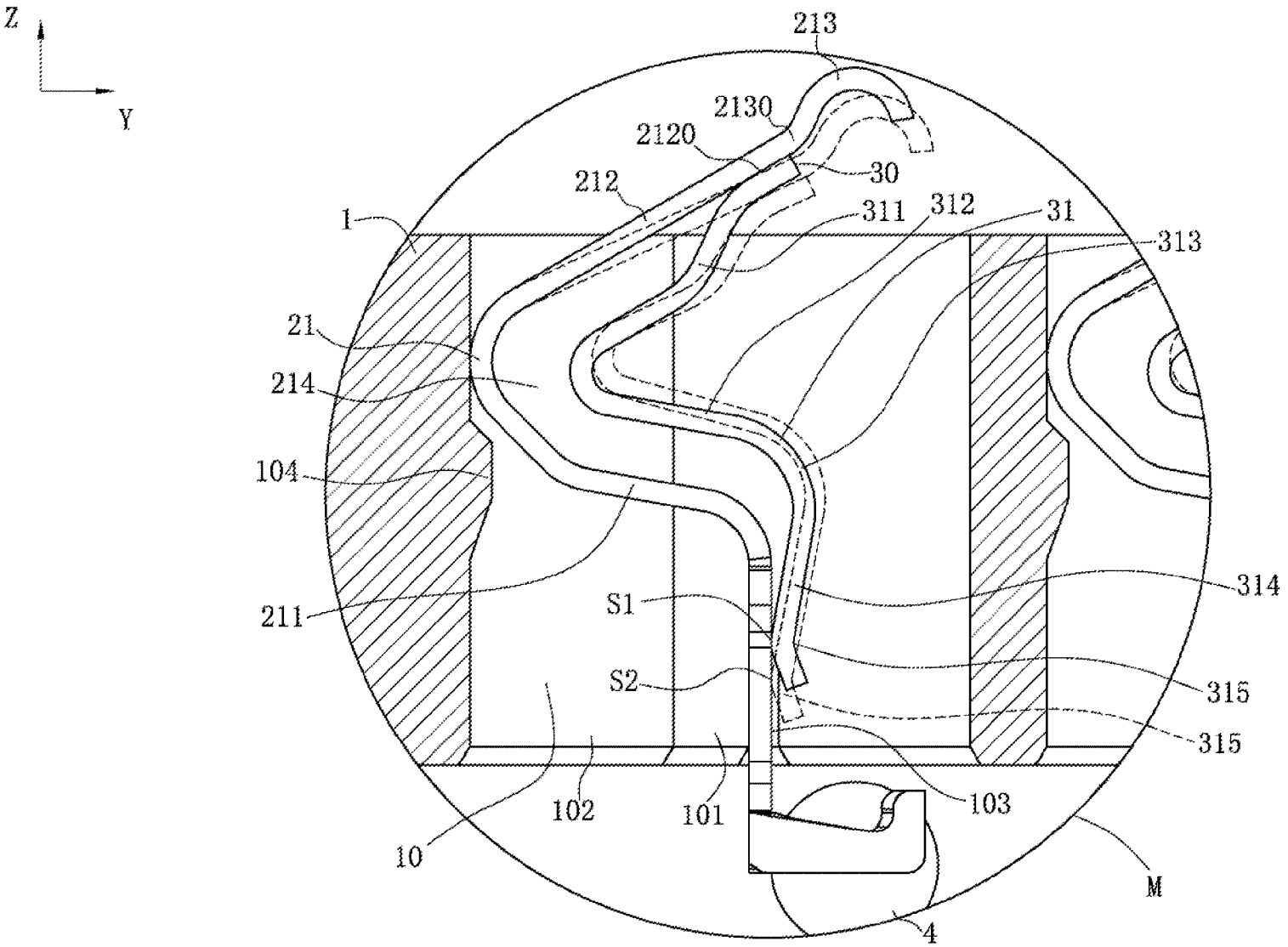
FIG. 7 is a partial enlarged plain view of FIG. 6.
Figure 8:
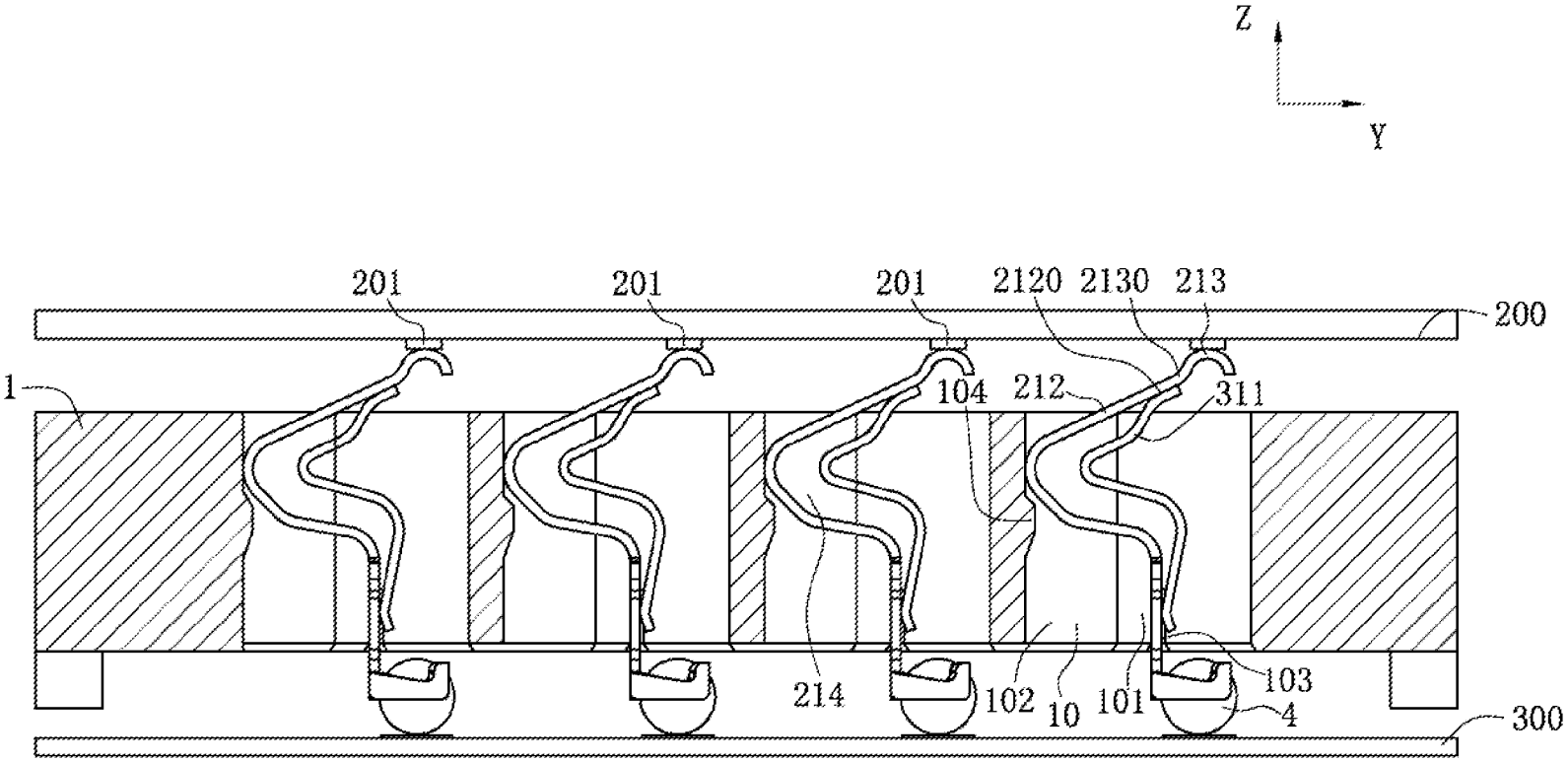
FIG. 8 is a plain sectional view of the electrical connector in FIG. 1 after being mated with the chip module.

Referring to FIG. 1, FIG. 3 and FIG. 6, a first direction Y and a second direction X perpendicular to each other are defined, and the first direction Y and the second direction X are perpendicular to the vertical direction Z. The insulating body 1 has multiple accommodating cavities 10 for correspondingly accommodating multiple terminals C. The accommodating cavities 10 are arranged to form multiple first rows A and multiple second rows B of accommodating cavities 10 provided in the first direction Y alternately at intervals. Two adjacent first rows A align with each other in parallel in the first direction Y, and two adjacent second rows B align with each other in parallel in the first direction Y. Each first row A and the adjacent second row B are provided staggeredly and parallelly in the first direction Y, and in the second direction X, a projection of each accommodating cavity 10 of the first row A and a projection of the adjacent accommodating cavity of the second row B are overlapped.

Referring to FIG. 1, FIG. 3 and FIG. 6, each accommodating cavity 10 runs through an upper surface and a lower surface of the insulating body 1. Each accommodating cavity 10 has a first cavity 101 and a second cavity 102 communicated with each other in the first direction Y and provided in rectangular shapes. A width of the first cavity 101 is greater than a width of the second cavity 102, and both the first cavity 101 and the second cavity 102 run through the upper and lower surfaces of the insulating body 1. The first cavity 101 and the second cavity 102 are used to accommodate at least part of the terminals C. Multiple retaining slots 103 extend upward from the lower surface of the insulating body 1 and do not run through the upper surface of the insulating body 1, and each retaining slot 103 and the corresponding first cavity 101 crisscross in a "+" shape. A height of the retaining slot 103 is roughly one third of a height of the insulating body 1. A positioning block 104 is protrudingly provided on an inner wall of the second cavity 102, and is used to position the terminal C in the vertical direction Z.

Referring to FIG. 1, FIG. 3 and FIG. 6, multiple first cavities 101 in each first row A and multiple second cavities 102 in the adjacent second row B are overlapped with their projections in the second direction X and are disposed alternately. Compared with a parallel aligned arrangement, the alternate design allows more accommodating cavities 10 to be formed on the insulating body 1 of the same size, such that more terminals C can be accommodated, thereby improving the electrical performance of the electrical connector 100. Each second cavity 102 is equally distanced from the first cavities 101 on the two adjacent sides, and the distance is substantially equal to the width of the second cavity 102, thereby ensuring the structural strength of the insulating body 1, and avoiding insufficient strength of the insulating body 1 caused by uneven wall thickness between the accommodating cavities 10. The width of the second cavity 102 is smaller than the width of the first cavity 101. Compared with the case where the first cavity 101 and the second cavity 102 have the same width, in the present embodiment, the wall between the first cavity 101 and the adjacent second cavity 102 is thickened, thus facilitating an increase of the strength of the insulating body 1.

Figure 4:
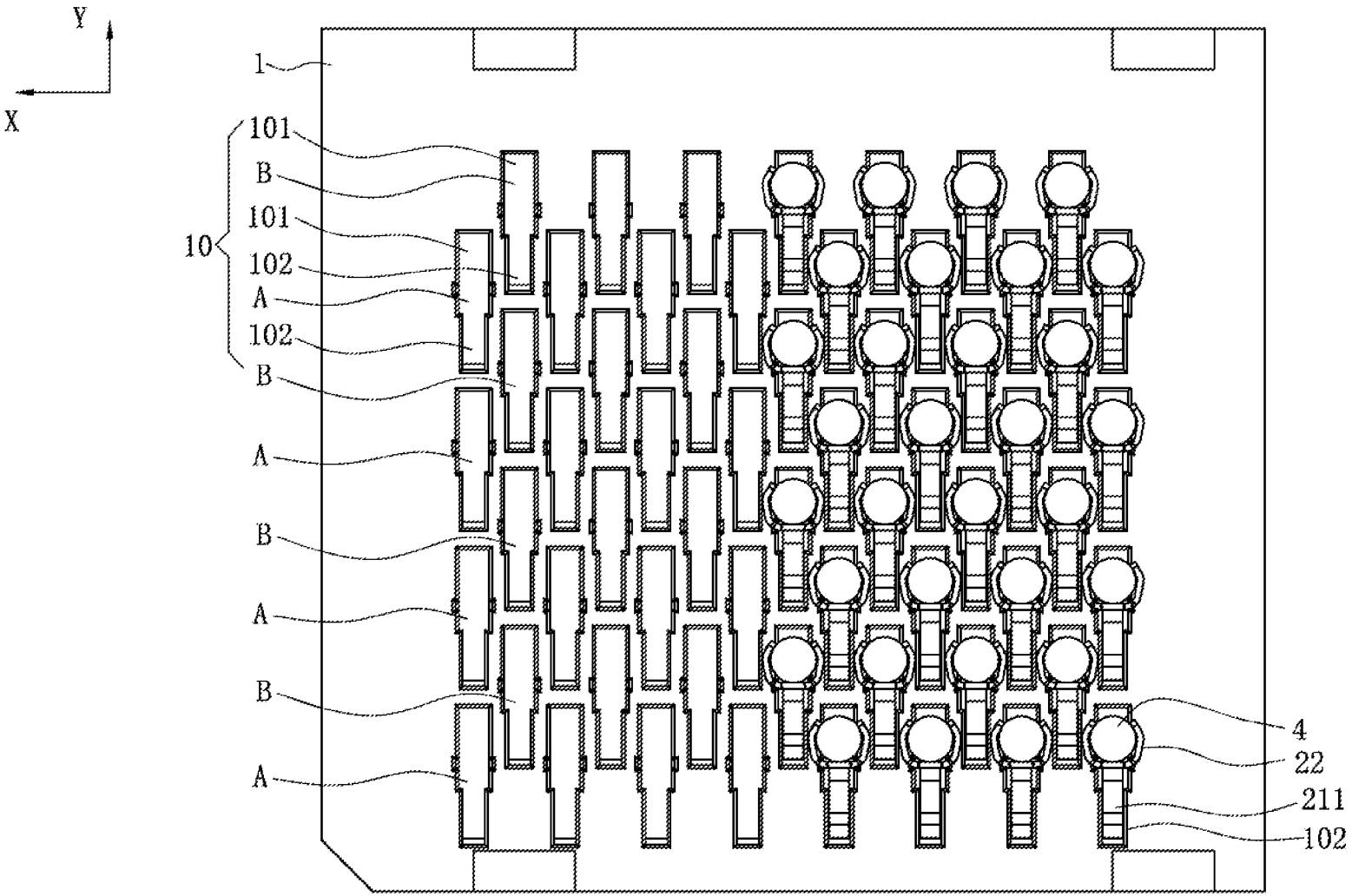
FIG. 4 is a plain view of the electrical connector in FIG. 1 viewing upward from bottom.
Figure 5:
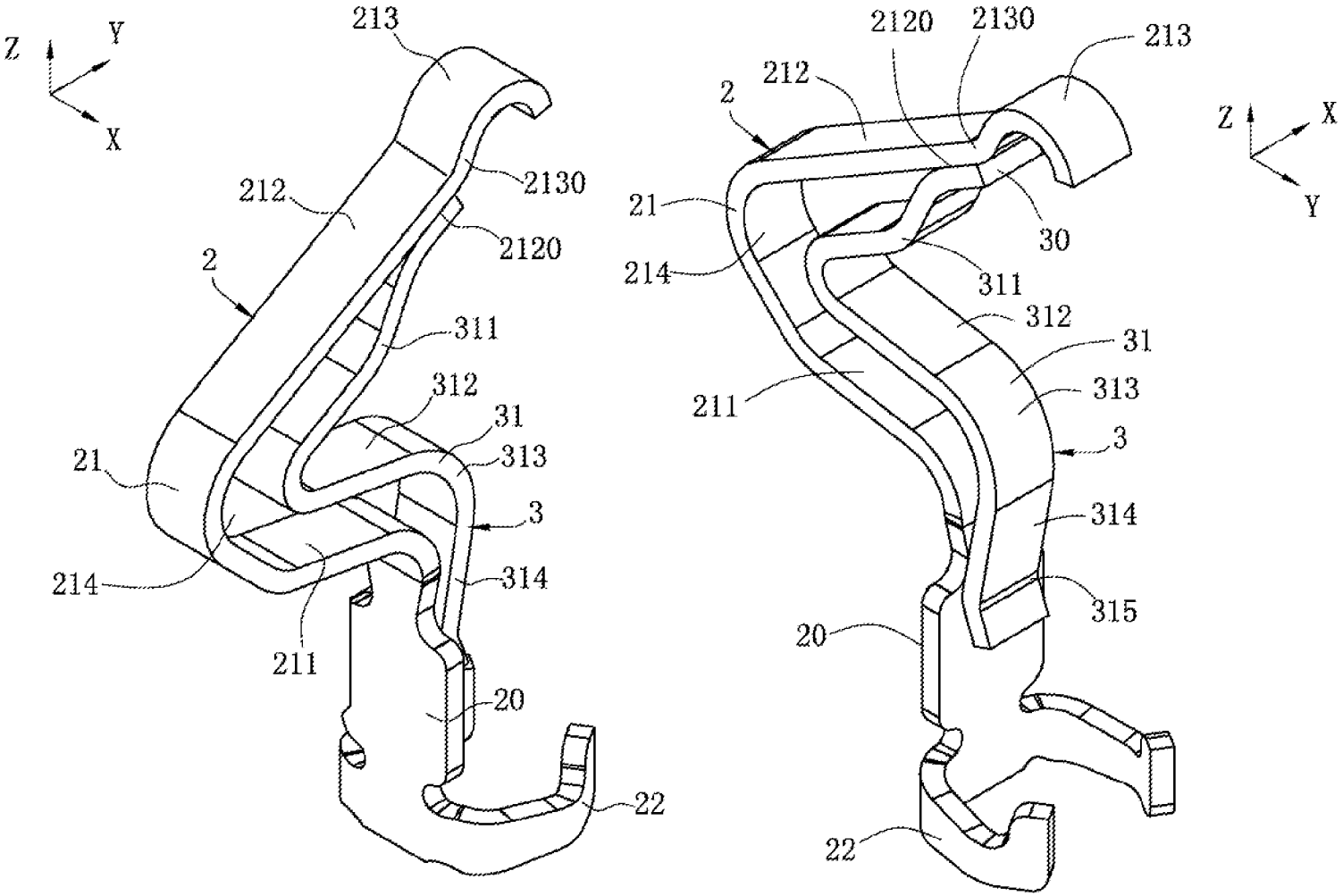
FIG. 5 is a perspective view of a terminal in FIG. 1.

Referring to FIG. 1, FIG. 4 and FIG. 5, each terminal C is formed by a first terminal 2 and a second terminal 3, which are independent from each other. The first terminal 2 and the second terminal 3 are punched from a same conductive metal sheet material. The first terminal 2 and the second terminal 3 are accommodated in the same accommodating cavity 10.

The first terminal 2 has a base 20, and the base 20 has a vertical plate surface and is fixed into the retaining slot 103. The base 20 determines a left-right direction Y and a width direction X perpendicular to each other. The left-right direction Y is perpendicular to the plate surfaces of the base 20, and the left-right direction Y and the width direction X are perpendicular to the vertical direction Z. A first elastic arm 21 extends upward from the base 20, and the first elastic arm 21 has a first portion 211 bending upward from the base 20 and extending leftward. The first elastic arm 21 has a second portion 212 bending upward from the first portion 211 and reversely to extend rightward, and the second portion 212 passes beyond a right plate surface of the base 20 rightward from left. The second portion 212 has a soldering location 2120, and the soldering location 2120 faces the second terminal 3 to be fixed to the second terminal 3 by soldering. A contact portion 213 bends and extends upward from the second portion 212, and the contact portion 213 is used to be in electrical contact with the chip module 200. A connecting location 2130 connecting the second portion 212 and the contact portion 213 is a bent shape, and the connecting location 2130 is adjacent to the soldering location 2120. The first portion 211 and the contact portion 213 are located at a left side and a right side of the base 20. The second portion 212 is mostly located on the left side of the base 20, and the connecting location 2130 is located on the right side of the base 20. Thus, when the contact portion 213 is abutted by the chip module 200, the first portion 211 and the second portion 212 located on the left side of the base 20 as well as the contact portion 213 may absorb an acting force of the chip module 200 in the left-right direction Y, thereby avoiding turnover deflection of the terminal C due to an unbalanced stress in the left-right direction Y, which may then affect the abutting contact between the contact portion 213 and the chip module 200. The first portion 211 and the second portion 212 form an accommodating space 214 recessing toward the left side of the base 20 to accommodate a portion of the second terminal 3.

A conduction portion 22 extends from each of two sides of the lower end of the base 20 in the width direction X respectively. The two conduction portions 22 are shaped like embracing arms away from each other and then close to each other in the width direction X. The two conduction portions 22 and the lower end of the base 20 jointly clamp the solder 4, and the terminal C is fixedly soldered to the gasket 301 through the solder 4, so as to be electrically connected to the circuit board 300.

The second terminal 3 has a fixed end 30 fixed and soldered to the first terminal 2. A third portion 311 bends and extends downward from the fixed end 30. A fourth portion 312 bends downward reversely from the third portion 311. A fifth portion 313 bends downward from the fourth portion 312. An abutting portion 315 extends downward from the fifth portion 313 to abut the first terminal 2. A connecting portion 314 connects the fifth portion 313 and the abutting portion 315, and the connecting portion 314 extends obliquely leftward and downward from right. The third portion 311, the fourth portion 312, the fifth portion 313, the connecting portion 314 and the abutting portion 315 form a second elastic arm 31, and the second elastic arm 31 has good elastic properties.

The second terminal 3 is fixed below the second portion 212 and located on a right side of part of the first terminals 2. The fixed end 30 are fixed and soldered below the soldering location 2120 in a face-to-face attaching contact manner. The current transmission paths are divided into two current transmission paths at the fixed end 30 and the soldering location 2120, thereby reducing the impedance of the terminal C, and further enabling the terminal C to transmit a larger signal. As the soldering location 2120 is located closer to the contact portion 213, the impedance of the terminal C is smaller. In the present embodiment, the soldering location 2120 is adjacent to the connecting location 2130, such that the electrical performance of the terminal C is good. Meanwhile, the contact portion 213 and the fixed end 30 are staggeredly provided in the vertical direction Z, thus facilitating the elasticity of the contact portion 213 to be maintained, and providing an elastic deformation space below the contact portion 213.

The third portion 311 and the fourth portion 312 are accommodated in the accommodating space 214, and the third portion 311 and the fourth portion 312 are located at a left side of the connecting location 2130, such that the second terminal 3 does not extend rightward beyond the contact portion 213, thereby reducing the overall size of the terminal C in the left-right direction Y, the distance between the third portion 311 and the fourth portion 312, and the distance between the second portion 212 and the first portion 211, and facilitating reduction of crosstalk during signal transmission of the terminal C and reduction of signal losses during transmission. The third portion 311 and the second portion 212 are provided face-to-face in the left-right direction Y, and the fourth portion 312 and the first portion 211 are provided face-to-face in the left-right direction Y, so as to reduce the overall size of the terminal C in the width direction X.

The fifth portion 313 extends out of the accommodating space 214, and passes beyond the right plate surface of the base 20. Since the fifth portion 313 is provided to bend leftward from right, the connecting portion 314 extends toward the right plate surface of the base 20, such that the abutting portion 315 abuts the right plate surface of the base 20. Since the fifth portion 313 is provided to bend leftward, the abutting portion 315 exerts a leftward pre-pressure onto the right plate surface of the base 20, thereby maintaining the contact stability between the base 20 and the abutting portion 315, reducing the contact impedance between the first terminal 2 and the second terminal 3, and facilitating the transmission of electrical signals.

The right plate surface of the base 20 is connected to the abutting portion 315 in a sliding contact manner, so as to determine a first position S1 and a second position S2 below the first position S1 on the base 20. When the contact portion 213 is abutted downward by the chip module 200, the abutting portion 315 may vertically slide between the first position S1 and the second position S2 along the base 20. The second position S2 is located closer to the conduction portion 22 than the first position S1, such that an electrical signal transmitted through the second terminal 3 can be transmitted from the second terminal 3 to the conduction portion 22 through a shorter conductive path, thereby accelerating transmission of the electrical signal. Meanwhile, the abutting portion 315 slides on the right plate surface of the base 20, such that the abutting portion 315 may scrape the right plate surface of the base 20, so as to scrape off substances affecting conductive transmission such as impurities, dust or an oxidized conductive layer on the right plate surface of the base 20, thereby further reducing contact impedance between the abutting portion 315 and the base 20, and facilitating transmission of the electrical signals.

After fixing and soldering, the first terminals 2 and the second terminals 3 are mounted in the accommodating cavities 10. The contact portion 213 is located above the insulating body 1 to abut and be in contact to the chip module 200. The soldering location 2120 and the fixed end 30 are located above the insulating body 1. The fixed end 30 and the second portion 212 are fixed by soldering, such that a stable effect therebetween is good. When the electrical connector 100 is in a mounting or transportation process, and an external force is applied to the terminal C, the first elastic arm 21 and the fixed end 30 cannot be easily separated, deflected or gapped regardless of the type of the external force, thereby maintaining a good electrical connection between the first elastic arm 21 and the fixed end 30, and facilitating transmission of the electrical signals. The conduction portion 22 is exposed below the insulating body 1, and a solder 4 attached to the conduction portion 22 is located below the insulating body 1, allowing the electrical connector 100 to be easily mounted on the circuit board 300.

The base 20 is fixedly accommodated in the retaining slot 103. The first portion 211 is accommodated across the first cavity 101 and the second cavity 102 leftward from right, and the second portion 212 is accommodated across the second cavity 102 and the first cavity 101 rightward from left and extends from the first cavity 101 to be above the insulating body 1. A connecting portion between the first portion 211 and the second portion 212 is located above the positioning block 104, and projections thereof are overlapped in the vertical direction Z, such that the positioning block 104 may prevent the first elastic arm 21 from excessive elastic deformation displacement in the vertical direction Z when the first elastic arm 21 is abutted downward by the chip module 200, thereby protecting the elastic properties of the first elastic arm 21, and facilitating the abutting stability between the first elastic arm 21 and the chip module 200. The first portion 211 is exposed on the lower surface of the insulating body 1 through the second cavity 102, the second portion 212 is exposed on the lower surface of the insulating body 1 through the second cavity 102, and air circulates on the upper and lower surfaces of the insulating body 1, so as to facilitate heat dissipation of the terminal C.

The third portion 311 is accommodated across the second cavity 102 and the first cavity 101 leftward from right, and the fourth portion 312 is accommodated across the second cavity 102 and the first cavity 101 rightward from left. A connecting portion between the third portion 311 and the fourth portion 312 is located in the second cavity 102, and aligns with the connecting portion between the first portion 211 and the second portion 212 in the left-right direction Y, such that the distance between the first portion 211 and the fourth portion 312 is substantially equal to the distance between the third portion 311 and the second portion 212, and the magnetic field between electrical signals passing through the first portion 211 and the second portion 212 and electrical signals passing through the third portion 311 and the fourth portion 312 is maintained to be relatively stable. Viewing downward from top, the third portion 311 is shielded and covered by the second portion 212. Viewing upward from bottom, the fourth portion 312 is shielded and covered by the third portion 311. Such arrangement facilitates reduction of the width of the terminal C, thereby allowing more terminals C to be provided on the insulating body 1 of the same size, and increasing the transmission efficiency of an electrical signal. The fifth portion 313 and the abutting portion 315 are accommodated in the second cavity 102. The abutting portion 315 and the fixed end 30 align with each other in the vertical direction Z, so as to ensure that, when the fixed end 30 moves downward, the abutting portion 315 also moves downward and does not move away from the base 20.

The retaining slot 103 extends into the second cavity 102, the base 20 is accommodated in the second cavity 102, and the first position S1 and the second position S2 are located in the first cavity 101. When the chip module 200 downward abuts the contact portion 213, the second portion 212 moves downward, and the fixed end 30 moves downward along with the second portion 212, such that the abutting portion 315 slides in the first cavity 101 between the first position S1 and the second position S2. In case where an external force applies, such as vibration during a transportation or mounting process, the insulating body 1 may protect the abutting portion 315, thereby avoiding deviation of the abutting portion 315 in the width direction X to cause the abutting portion 315 to separate from the base 20, or avoiding unstable abutting between the abutting portion 315 and the base 20 due to the damaged elastic properties of the abutting portion 315.

To sum up, the electrical connector 100 according to certain embodiments of the present invention has the following beneficial effects:

1. The soldering location 2120 and the fixed end 30 are located above the insulating body 1. The fixed end 30 and the second portion 212 are fixed by soldering, such that a stable effect therebetween is good. When the electrical connector 100 is in a mounting or transportation process, and an external force is applied to the terminal C, the first elastic arm 21 and the fixed end 30 cannot be easily separated, deflected or gapped regardless of the type of the external force, thereby maintaining a good electrical connection between the first elastic arm 21 and the fixed end 30, and facilitating transmission of the electrical signals.

2. When the contact portion 213 is abutted downward by the chip module 200, the abutting portion 315 may vertically slide downward between the first position S1 and the second position S2 along the base 20. The second position S2 is located closer to the conduction portion 22 than the first position S1. Compared with the case where the abutting portion 315 abuts the first position S1, the abutting portion 315 abutting the second position S2 allows an electrical signal transmitted through the second terminal 3 to be transmitted from the second terminal 3 to the conduction portion 22 through a shorter conductive path, thereby accelerating transmission of the electrical signal.

3. The abutting portion 315 slides on the right plate surface of the base 20, such that the abutting portion 315 may scrape the right plate surface of the base 20, so as to scrape off substances affecting conductive transmission such as impurities, dust or an oxidized conductive layer on the right plate surface of the base 20, thereby further reducing contact impedance between the abutting portion 315 and the base 20, and facilitating transmission of the electrical signals.

4. When the contact portion 213 and the fixed end 30 are staggeredly provided in the vertical direction Z, an angle is formed between the direction of an acting force exerted on the abutting portion 315 and the vertical direction Z, resulting in the abutting portion 315 turning over in the vertical direction Z, such that the base 20 and the abutting portion 315 become separated from each other instead of being in abutting contact, and the second elastic arm 31 cannot transmit the electrical signal to the conduction portion 22, which causes the second elastic arm 31 to form an invalid conductive transmission path. In the present embodiment, the abutting portion 315 and the fixed end 30 align with each other in the vertical direction Z, so as to ensure that, when the fixed end 30 moves downward, the abutting portion 315 abuts the base 20. The base 20 is provided vertically, such that the abutting portion 315 may move downward along the base 20, and the abutting portion 315 is always in contact with the base 20 during a downward moving process of the abutting portion 315. The electrical signals passing through the second terminal 3 may always be transmitted to the conduction portion 22, so as to ensure the stability of signal transmission.

5. The connecting portion between the first portion 211 and the second portion 212 is located above the positioning block 104, and projections thereof are overlapped in the vertical direction Z, such that the positioning block 104 may prevent the first elastic arm 21 from excessive elastic deformation displacement in the vertical direction Z when the first elastic arm 21 is abutted downward by the chip module 200, and the first elastic arm 21 does not plastically deform, thereby protecting the elastic properties of the first elastic arm 21, and facilitating the abutting stability between the first elastic arm 21 and the chip module 200.

6. Since the fifth portion 313 is provided to bend leftward, the abutting portion 315 exerts a leftward pre-pressure onto the right plate surface of the base 20. In the process where the abutting portion 315 moves downward along the base, the abutting portion 315 is tightly attached to the right plate surface of the base 20 due to the leftward pre-pressure, thereby maintaining the contact stability between the base 20 and the abutting portion 315. Compared with a loose contact between the abutting portion 315 and the base 20, the tight attachment between the abutting portion 315 and the base 20 may reduce impurities therebetween, thereby reducing the contact impedance between the first terminal 2 and the second terminal 3, and facilitating the transmission of electrical signals. Meanwhile, in the process where the abutting portion 315 moves downward along the base, the abutting portion 315 is tightly attached to the right plate surface of the base 20, and the electrical signals passing through the second terminal may always be transmitted to the base 20 through the abutting portion 315, so as to ensure the stability of signal transmission.

7. Multiple first cavities 101 of the accommodating cavities 10 in each first row A and multiple second cavities 102 of the accommodating cavities 10 in the adjacent second row B are overlapped with their projections in the second direction X and are disposed alternately. Compared with the parallel aligned arrangement of multiple accommodating cavities on the insulating body, the alternate design allows more accommodating cavities 10 to be formed on the insulating body 1 of the same size, such that more terminals C can be accommodated, thereby improving the electrical performance of the electrical connector 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect an electronic component to a circuit board, the electrical connector comprising:

an insulating body;

at least one first terminal, having a base accommodated in the insulating body, and a first elastic arm extending upward from the base and at least partially located above the insulating body, wherein the first elastic arm is configured to abut the electronic component; and at least one second terminal, having a fixed end and a second elastic arm connected to each other, wherein the fixed end is at least partially located above the insulating body and fixed to the first elastic arm, and at least a portion of the second elastic arm is located in the insulating body and is slidably in contact with the first terminal, wherein the first elastic arm has a first portion bending and extending upward from the base, and a second portion bending and extending upward from the first portion, the first portion and the second portion form an accommodating space, and the second elastic arm is at least partially accommodated in the accommodating space.

2. The electrical connector according to claim 1, wherein a left-right direction is defined to be perpendicular to a plate surface of the base, the first portion extends leftward from the base, the second portion bends reversely from the first portion and extends rightward from left, a contact portion extends upward from the second portion and configured to be in electrical contact with the electronic component, and the first portion and the contact portion are respectively located at a left side and a right side of the base.

3. The electrical connector according to claim 2, wherein the second elastic arm has a third portion and a fourth portion accommodated in the accommodating space, the third portion is connected upward to the fixed end, the fourth portion bends and extends downward from the third portion, and the third portion and the fourth portion are located at a left side of a location connecting the contact portion and the second portion.

4. The electrical connector according to claim 3, wherein the third portion and the second portion are provided face-to-face in the left-right direction, and the fourth portion and the first portion are provided face-to-face in the left-right direction.

5. The electrical connector according to claim 3, wherein a fifth portion extends and bends downward from the fourth portion, an abutting portion extends from the fifth portion toward the base and configured to abut the base, a connecting portion connects the abutting portion and the fifth portion, and the connecting portion extends obliquely downward from top toward the base.

6. The electrical connector according to claim 5, wherein a projection of the abutting portion and a projection of the fixed end in a vertical direction are overlapped.

7. An electrical connector, configured to electrically connect an electronic component to a circuit board, the electrical connector comprising:

an insulating body;

at least one first terminal, having a base accommodated in the insulating body, and a first elastic arm extending upward from the base and at least partially located above the insulating body, wherein the first elastic arm is configured to abut the electronic component; and at least one second terminal, having a fixed end and a second elastic arm connected to each other, wherein the fixed end is at least partially located above the insulating body and fixed to the first elastic arm, at least a portion of the second elastic arm is located in the insulating body and is slidably in contact with the first terminal, and the fixed end and the first elastic arm are face-to-face soldered to each other.

8. The electrical connector according to claim 7, further having a plurality of first terminals and a plurality of second terminals, wherein the insulating body has a plurality of accommodating cavities running vertically and configured to correspondingly accommodate the first terminals and the second terminals, and each of the accommodating cavities correspondingly accommodates one of the first terminals and one of the second terminals.

9. The electrical connector according to claim 8, wherein each of the accommodating cavities has a first cavity and a second cavity communicated with the first cavity, a width of the first cavity is greater than a width of the second cavity, the base is fixed to the first cavity, the first elastic arm is at least partially across and accommodated in the first cavity and the second cavity, and the first elastic arm extends out of the insulating body from the first cavity.

10. The electrical connector according to claim 9, wherein a lower end of the second elastic arm has an abutting portion, and the abutting portion is accommodated in the first cavity and slidably in contact with the base.

11. The electrical connector according to claim 10, wherein the second elastic arm is at least partially across and accommodated in the first cavity and the second cavity.

12. The electrical connector according to claim 8, wherein a first direction and a second direction perpendicular to each other are defined, the accommodating cavities form a first row and a second row of the accommodating cavities in the first direction provided in parallel and staggeredly, each of the accommodating cavities has a first cavity and a second cavity communicated with each other and running through an upper surface and a lower surface of the insulating body, a width of the first cavity is greater than a width of the second cavity, and a projection of the first cavity of each of the accommodating cavities in the first row and a projection of the second cavity of each of the accommodating cavities in the second row in the second direction are overlapped.

13. The electrical connector according to claim 12, wherein the first elastic arm and the second elastic arm are at least partially accommodated in the second cavity, the first elastic arm is exposed on the upper surface of the insulating body and the lower surface of the insulating body through the second cavity.

14. The electrical connector according to claim 13, wherein when viewing the second cavity downward from top, the first elastic arm at least partially shields the second elastic arm, and when viewing the second cavity upward from bottom, the first elastic arm at least partially shields the second elastic arm.

15. The electrical connector according to claim 14, wherein the first cavity of one of the accommodating cavities in the second row is provided between the second cavities of two adjacent ones of the accommodating cavities in the first row.

16. The electrical connector according to claim 15, wherein a conduction portion extends downward from each of the first terminals, the conduction portion is exposed on the lower surface of the insulating body, and a projection of the conduction portion and a projection of the corresponding first cavity in a vertical direction are overlapped.

17. An electrical connector, configured to electrically connect an electronic component to a circuit board, the electrical connector comprising:

an insulating body;

at least one first terminal, having a base fixed to the insulating body, a first elastic arm extending upward from the base out of an upper surface of the insulating body and configured to be in electrical contact with the electronic component, and a conduction portion extending from a lower end of the base and configured to be electrically connected to the circuit board; and at least one second terminal, having a fixed end and a second elastic arm extending downward from the fixed end, wherein the fixed end is soldered to the first elastic arm, the second elastic arm is slidably in contact with the base, the base has a first position and a second position, the first position is higher than the second position, the second elastic arm slidably move back and forth along the first position and the second position, and when the electronic component downward abuts the first elastic arm, the second elastic arm slides from the first position to the second position.

18. The electrical connector according to claim 17, wherein an upper end of the first elastic arm has a contact portion configured to be electrically connected to the electronic component, the fixed end is fixed below the contact portion, and the fixed end and the contact portion are staggeredly provided in a vertical direction.

19. The electrical connector according to claim 17, wherein the second position is located closer to the conduction portion than the first position.

20. The electrical connector according to claim 17, wherein the insulating body has at least one accommodating cavity configured to accommodate the first terminal and the second terminal, and the first position and the second position are located in the accommodating cavity.

21. The electrical connector according to claim 1, further having a plurality of first terminals and a plurality of second terminals, wherein the insulating body has a plurality of accommodating cavities running vertically and configured to correspondingly accommodate the first terminals and the second terminals, each of the accommodating cavities correspondingly accommodates one of the first terminals and one of the second terminals, each of the accommodating cavities has a first cavity and a second cavity communicated with the first cavity, a width of the first cavity is greater than a width of the second cavity, the base is fixed to the first cavity, the first elastic arm is at least partially across and accommodated in the first cavity and the second cavity, and the first elastic arm extends out of the insulating body from the first cavity.

22. The electrical connector according to claim 21, wherein a lower end of the second elastic arm has an abutting portion, and the abutting portion is accommodated in the first cavity and slidably in contact with the base.

23. The electrical connector according to claim 1, further having a plurality of first terminals and a plurality of second terminals, wherein the insulating body has a plurality of accommodating cavities running vertically and configured to correspondingly accommodate the first terminals and the second terminals, each of the accommodating cavities correspondingly accommodates one of the first terminals and one of the second terminals, a first direction and a second direction perpendicular to each other are defined, the accommodating cavities form a first row and a second row of the accommodating cavities in the first direction provided in parallel and staggeredly, each of the accommodating cavities has a first cavity and a second cavity communicated with each other and running through an upper surface and a lower surface of the insulating body, a width of the first cavity is greater than a width of the second cavity, and a projection of the first cavity of each of the accommodating cavities in the first row and a projection of the second cavity of each of the accommodating cavities in the second row in the second direction are overlapped.

24. The electrical connector according to claim 23, wherein the first elastic arm and the second elastic arm are at least partially accommodated in the second cavity, the first elastic arm is exposed on the upper surface of the insulating body and the lower surface of the insulating body through the second cavity.

* * * * *